United States Patent [19]

Ishii et al.

[11] Patent Number: 4,822,662

[45] Date of Patent: Apr. 18, 1989

[54] MACHINE PARTS WITH WEAR-RESISTANT SURFACE BROUGHT INTO CONTACT WITH ELONGATED FIBROUS MEMBER

[75] Inventors: Takashi Ishii, Tokyo; Hajime Kohama, Yokohama; Hisao Yabe, Fujisawa; Akira Yano; Shinsuke Noto, both of Kanazawa, all of Japan

[73] Assignees: Kabushiki Kaisha Toshiba, Kawasaki; Yano Kousakujo Corporation; Notoshiti Corporation, both of Kanazawa, all of Japan

[21] Appl. No.: 852,219

[22] Filed: Apr. 15, 1986

[30] Foreign Application Priority Data

| | | | |
|---|---|---|---|
| Apr. 17, 1985 | [JP] | Japan | 60-82057 |
| Jun. 29, 1985 | [JP] | Japan | 60-143295 |
| Aug. 28, 1985 | [JP] | Japan | 60-187328 |
| Sep. 11, 1985 | [JP] | Japan | 60-200854 |
| Sep. 11, 1985 | [JP] | Japan | 60-200855 |

[51] Int. Cl.[4] ..... B32B 3/10; B32B 15/14

[52] U.S. Cl. ..... 428/131; 428/135; 428/136; 428/224; 428/225; 428/226; 428/335; 428/336; 428/420; 428/469

[58] Field of Search ..... 427/226; 428/469, 131, 428/335, 336, 420, 224, 225, 226, 135, 136

[56] References Cited

U.S. PATENT DOCUMENTS

| | | | |
|---|---|---|---|
| 3,956,531 | 5/1976 | Church et al. | 427/226 |
| 3,985,916 | 10/1976 | Church et al. | 427/226 X |

*Primary Examiner*—Thomas J. Herbert
*Attorney, Agent, or Firm*—Oblon, Fisher, Spivak, McClelland & Maier

[57] ABSTRACT

Machine parts to be brought into contact with an elongated fibrous member each consists of a substrate of an iron series metal and a surface layer which has high wear-resistance and a good sliding property, and which contains chromium oxide as a major constituent. The chromium oxide is converted from a chromium compound upon heating. An intermediate layer containing a reaction product between the chromium oxide in the surface layer and the substrate is formed at an interface between the surface layer and the substrate.

11 Claims, 5 Drawing Sheets

MACHINE PARTS WITH WEAR-RESISTANT SURFACE BROUGHT INTO CONTACT WITH ELONGATED FIBROUS MEMBER

BACKGROUND OF THE INVENTION

I. Field of the Invention

The present invention relates to machine parts with a wear-resistant surface brought into contact with an elongated fibrous member such as a strand or yarn and, more particularly, to textile machine parts.

II. Description of the Prior Art

Many parts brought into contact with a running strand or yarn are included in fiber machines such as spinning machines, weaving machines (looms), knitting machines, braiding machines, and sewing machines. As a result of stronger, harder thread or yarn, the wear-resistant properties of parts brought into contact therewith have become more important. To describe the wear-resistant properties of machine parts in this specification, a weaving machine will be used.

The weaving machine (loom) is a machine for weaving a fabric by crossing warps and a weft. A typical example of a conventional weaving machine is illustrated in FIG. 1. In the weaving machine of FIG. 1, heald 1 and reed 2 are arranged along the moving direction of warps a.

A plurality of healds 1 are arranged corresponding to each of a plurality of warps a to be aligned along the running direction thereof. Each heald 1 has a shape and structure as shown in FIG. 3. Heald 1 has mail 11 at its center and mounting holes 12 at its ends. A warp passes through mail 11 and heald bars (not shown) pass through holes 12 to hold heald 1 to a heald frame. Therefore, parallel healds 1 are mounted in the heald frame through the heald bars passing through holes 12 of healds 1. The frame is vertically moved by a mechanism (not shown), and the heald bars and healds 1 are moved together, thereby vertically moving warps a.

As shown in FIGS. 4 and 5, reed 2 is arranged such that a large number (e.g., 3,000) of reed wires 3 are aligned like a comb at a predetermined pitch and are fixed to rectangular frame 21. Warps a are respectively inserted between adjacent wires 3. As shown in FIG. 2, reed 2 is pivoted in the direction of the arrows to hit and force weft b in the moving direction of warps a to evenly space the yarns.

Referring to FIGS. 1 and 2, many warps a supplied from a thread or yarn supply mechanism (not shown) are moved in the direction shown by the arrows and taken up by take-up mechanism 5. At an intermediate position, warps a pass through mails 11 of healds 1 and between adjacent reed wires 3 of reed 2. Warps a are vertically moved upon vertical movement of healds 1. As shown in FIG. 2, when warps a are alternately located at upper and lower positions, weft b supplied from main nozzle or weft inserting mechanism 4 passes between the upper warps a1 and lower warps a2, and reed 2 is pivoted in the running direction of warps a to beat up weft b. By repeating the above operation, fabric c is woven.

In a conventional fluid jet type weaving machine, weft b is carried by a fluid jet sprayed from main nozzle 4 arranged at the side of the machine. In this case, the pressure of the fluid jet decreases as it is separated from nozzle 4, and thus its carrying force is decreased. A plurality of sub nozzles 31 are arranged at a predetermined pitch along the feed direction of weft b, as shown in FIGS. 6 and 7. A pressurized lfuid is sprayed from nozzles 31 toward weft b from below, so that weft b is supported by the pressurized fluid. As a result, the feed force of the fluid jet can be reinforced.

The heald, reed, and sub nozzles as weaving machine parts described above are normally made of an iron series metal such as carbon steel or stainless steel, which causes the following problems.

When healds 1 are vertically moved together with the frame, there is fuiction between the metal heald bars and holes 12 formed at both ends of each heald 1, and at the same time, friction occurs between warp a and the corresponding inner edge of mail 11. Holes 12 are thus worn by friction with the heald bars and finally become highly damaged. In the worst case, heald 1 becomes detached from the heald bar. The inner edge of mail 11 of heald 1 is also damaged by friction with warp a passing therethrough. Warp a frays because of this damage, and degrades the cloth feeling. In the conventional water jet type weaving machine, droplets of water from a water jet (natural water) used for feeding weft b adhere to the surface of heald 1. Foreign material contained in the water jet reacts with the metal of the heald, and a layer of foreign material is formed on the surface of the heald. Warp a passing through heald 1 frays because of this foreign material layer. At the same time, the thickness of heald 1 is increased due to the presence of the foreign material layer, and adjacent healds 1 are brought into contact with each other, thus interfering with heald movement.

In order to solve the above problem, the following solution has been attempted in recent years. A surface layer of a material different from that of the heald is formed on the surface of the heald to prevent it from being worn by friction between the heald and the heald bar and between the warp and the heald, and to prevent formation of a foreign material layer on the heald surface.

The surface layer formed on the heald surface must satisfy the following requirements. The surface layer must have wear-resistant properties able to prevent wear of the heald in association with friction with the heald bar and the warp. At the same time, the suface layer must be thin and firmly formed on the heald surface. Upon formation of such a surface layer, the properties of heald itself must not be degraded and surface finishing, such as polishing, should not be required. The latter requirement is based on the assumption that, since the heald is small, surface finishing is cumbersome.

The same solution as described above has also been attempted for the reed. A surface layer of a material different from that of the reed is formed on the reed wire surface to reduce friction with the warp.

This surface layer must satisfy the following requirements. The surface layer must have enough wear-resistance to endure friction with the warp. Since the reed wire is elastically flexed to follow the movement of the warp, the surface layer must be firmly formed on the reed wire surface so as not to peel therefrom. Furthermore, the surface layer must be thin, since the distance between adjacent reed wires is very small.

The sub nozzle used in the fluid jet type weaving machine presents the following problem. As shown in FIGS. 6 and 7, nozzle 31 is fixed at a predetermined position and is located under warps a when they are horizontally aligned. When warps a are separated, nozzle 31 is located between warps a, as shown in FIGS. 6 and 7 and sprays the pressurized fluid on weft b. In this case, when nozzle 31 is moved relative to the pair of warps a and catches them, warps a fray, thus degrading the cloth feeling. Therefore, nozzle 31 must have a smooth outer surface to allow sliding of warps a when nozzle 31 is brought into contact with warps a. Furthermore, the outer surface of nozzle 31 is worn due to contact with warps a and must have good wear-resistant property.

The same solution as for the healds and reed wires has also been attempted for the sub nozzle. A surface layer of a material different from that of the sub nozzle is formed thereon, to prevent the outer surface of the sub nozzle from snagging the warps and from being worn by friction with the warps.

The surface layer formed on the nozzle surface must satisfy the following requirements. The surface layer must have a sliding property for allowing smooth sliding of the warps upon contact therewith. The surface layer must also have enough wear-resistance to endure friction with the warps. The surface layer must be firmly formed on the nozzle surface and must not degrade the nozzle material. After formation of such a surface layer, surface finishing such as polishing should not be required.

In addition to the healds, reed wires, and sub nozzles, the conventional weaving machine has other machine parts that are brought into sliding contact with the warps and the weft. Examples of these parts are a tension roller, a measuring roller, a yarn hook and a needle. For example, the tension roller causes two disks to clamp a yarn therebetween to apply an optimal tension force to the yarn. The measuring roller holds weft according to the width of the fabric. The yarn hook holds the yarn. The needle is a needle member for knitting the yarn. These machine parts are normally made of an iron series material.

The use of these machine parts has the following problems. Since the parts are operated while being in sliding contact with the warp or weft, when sliding contact is poor, the yarn frays to degrade feeling of the resultant cloth. Therefore, the parts must have smooth surfaces to prevent the yarn from being snagged thereby during operation. Furthermore, since the surfaces of the machine parts are worn due to sliding contact with the yarn, these surfaces must have a good wear-resistant property.

In order to prevent the yarn from fraying and the cloth feeling from being degraded, surface layers of a material different from that of the machine parts must be formed thereon.

These surface layers must satisfy the following requirements. Each surface layer must be smooth or have a sliding property good enough to allow smooth sliding contact with the running yarn, and have a good wear-resistant property. The surface layer must also be firmly formed on the parts surface and must not degrade the material of the machine parts. The surface layer should not require surface finishing after its formation. Furthermore, the surface layer must be formable on even small, complicated machine parts.

Methods of forming a surface layer on a heald, a reed wire, a sub nozzle or other machine parts are exemplified by (a) a hard chromium plating method, (b) a PVD (physical vapor deposition) method, (c) a flame spraying method, or (d) a CVD (chemical vapor deposition) method. However, each method presents the following problems and cannot be used in practical applications. Formation of a surface layer on a surface of a reed wire is exemplified below.

(a) A film formed by the hard chromium plating method has a good wear-resistant property, but poor resistance to chemicals. Since an oil is applied to the surface of warps to improve its binding force, the surface layer on the reed wire often reacts chemically with the oil.

(b) Vapor evaporation is a typical example of the PVD method. If titanium carbide is evaporated and formed on the surface of the reed wire, it has poor adhesion with the reed wire and tends to peel off when the reed wire elastically flexes. In the evaporation step, a film tends not to be formed on an unexposed poriton to the evaporation source, and thus, a uniform film cannot be formed.

(c) If a tungsten carbide film is formed by flame spraying on the surface of the reed wire, the film surface must be polished. The film formed by flame spraying is very hard, and the reed wire is very thin. It is thus difficult to perform such polishing.

(d) If a titanium carbide film is formed by the CVD method on the surface of the reed wire, a high temperature of 700 to 1,200° C. is required. Elasticity of the reed wire is degraded at such high temperatures.

When the films are formed on the surfaces of healds, sub nozzles and other machine parts according to methods (a) to (d), the resultant films cannot satisfy the specific requirements and thus cannot be used in practice.

SUMMARY OF THE INVENTION

It is an object of the present invention to provide machine parts in contact with an elongated fibrous member and having a surface layer, wherein the surface layer is very thin, has high wear-resistance, high resistance to chemicals, and good adhesion with a substrate, and can be easily formed without degradation of the substrate.

According to the present invention, there is provided machine parts in contact with an elongated fibrous member, comprising a substrate of an iron series metal and a surface layer formed on a surface of the substrate and containing chromium oxide ($Cr_2O_3$) as a major constituent. The chromium oxide ($Cr_2O_3$) is a material converted by heatign a chromium compound, and an intermediate layer containing a reaction product between the substrate and chromium oxide in the surface layer is formed at an interface between the surface layer and the substrate.

The machine parts of the present invention include various parts in contact with the elongated fibrous member. Examples of such machine parts are weaving machine parts such as a heald, a reed, a sub nozzle, a tension roller, a measuring roller, a yarn hook, a needle, and other guide members.

Examples of the elongated fibrous member in contact with the machine parts of the present invention are a yarn, a strand, and a thread of a fibrous material such as a natural fiber, an inorganic fiber, a synthetic fiber, or a glass fiber.

Examples of the substrate of the machine parts are carbon steel, stainless steel or other iron alloys.

The surface layer formed on the substrate of the machine parts according to the present invention has a dense structure of chromium oxide ($Cr_2O_3$) particles converted from a chromium compound upon heating and firmly bonded to each other. The surface layer is smooth and has a good wear-resistant property. Since the size of the precipitated $Cr_2O_3$ ceramic particles is very small (1 μm or less), the surface layer can be a dense, smooth layer substantially without pores and can be formed to be very thin. Therefore, inherent characteristics (e.g., elasticity) of the substrate can be effectively utilized. The hardness of the surface layer is as high as a Vicker's hardness (HV) of 500 or more. The intermediate layer as a reacton product between the material and chromium oxide is formed at the interface between the surface layer and the substrate. The surface layer can be formed on the substrate at high adhesion strength (500 kgf/cm$^2$). A thickness of the intermediate layer falls within the range of 0.5 to 3.0 μm. The surface layer also has high resistance to corrosion, a property for eliminating foreign materials, and high resistance to chemicals.

The intermediate layer described preferably contains $FeO \cdot Cr_2O_3$.

Chromium oxide ($Cr_2O_3$) contained in the surface layer serves to increase hardness and decrease a friction coefficient.

Machine parts with such a surface layer are manufactured by the following method. According to this method, a chromium compound solution such as an aqeuous solution of $CrO_3$ is applied to the surface of the substrate by means of coating or dipping. The substrate applied with the $CrO_3$ solution is baked at a temperature of 500 to 600° C. (preferably about 550° C.) in a reaction treatment, thereby forming a layer containing $Cr_2O_3$ as a major constituent on a substrate surface region. A baking temperature of 500 to 600° C. allows conversion of $CrO_3$ to $Cr_2O_3$. A cycle of $CrO_3$ application and baking is repeated a plurality of times to form a dense, hard ceramic coating layer containing $CrO_2O_3$ on the surface of the substrate. A thickness of this layer is 1 to 50 μm. In this manner, the thickness is controlled by the number of cycles repeated as above. A thickness of the surface layer of the machine parts is preferably 1 to 10 μm, and more preferably, 2 to 6 μm. Since the baking temperature range falls within the range of 500 to 600° C., the substrate is not degraded.

Any chromium compound, including $CrO_3$ to be converted to $Cr_2O_3$ by heating, can be used. Examples of such a chromium compound are $NaCrO_4.10H_2O$, $Na_2Cr_2O_7.2H_2O$, $K_2CrO_4$, $K_2Cr_2O_7$ and $(NH_4)_2Cr_2O_7$. In addition, the solution is not limited to an aqueous solution, but can be substituted by a molten salt. A concentration of the solution is preferably 10 to 60%.

A porous ceramic layer can be formed on the surface of the substrate by coating and heating a chromium compound containing wear-resistant particles such as $Al_2O_3$ or $SiO_2$ particles. The porous ceramic layer can be formed prior to formation of the chromium compound solution upon coating and heating. In this manner, a thick surface layer with high wear-resistance can be formed. However, this method cannot be preferably applied to the formation of thin surface layers on reed wires and sub nozzles. The method of forming a surface layer by adding wear-resistant particles in the chromium compound solution and the method thereof without adding them are selectively used, with consideration given to various conditions such as application. The latter method provides a dense, smooth, thin surface layer. Furthermore, since this method requires only a low treatment temperature, the surface layer can be formed inside apertures of the machine parts.

When the present invention is applied to formation of the surface layer on the entire surface of a heald, a wear-resistant surface layer can be formed on the inner surface of the mounting holes, wear between the heald and the heald bar can be decreased, and thus the mounting hole portions will be neither worn out nor become detached from the heald bar. The warp will substantially not fray, even when it runs through the mail at the center of the heald, due to the presence of the smooth surface layer. At the same time, wear of the surface layer owing to friction with the warp can be reduced. Since the surface layer has an anti-corrosion property, i.e., the property with which the surface layer does not react with foreign materials contained in water from the water jet, a foreign material layer is not formed. As a result, the warp does not fray and the foreign material layer is not formed on a given heald to interfere with the movement of adjacent healds. By using a heald with such a surface layer, the warp will substantially not fray and cloth with a good feeling can be obtained. In addition, the surface layer can be formed without degrading the substrate of the heald, and surface finishing need not be performed. Since the surface layer is firmly formed on the surface of the substrate and does not peel therefrom, the heald can be used for a long period of time under optimum conditions. Furthermore, since the surface layer is thin, it does not interfere with heald movement.

When the present invention is applied to a reed, i.e., when a wear-resistant surface layer is formed on a reed wire, the warp will substantially not fray because of the presence of the surface layer to provide cloth with a good feeling. The wear of the surface layer is small since friction between the surface layer and the warp is small. The surface layer cannot be chemically corroded by an oil applied to the warp. Furthermore, good adhesion between the substrate and the surface layer can be achieved: even if the reed wire is elastically flexed upon movement of the warp, the surface layer does not peel off the surface of the substrate. Therefore, the reed wires can be used for a long period of time under optimum conditions. In addition, since a thin surface layer can be formed on the reed wire, the layer does not interfere with movement of adjacent reed wires.

When the present invention is applied to a sub nozzle, a surface layer on the sub nozzle is smooth and has a good sliding property, and the warp slides easily along the surface layer and is not snagged thereby. Thus, the warp will substantially not fray, so that the resultant cloth is free from quality degradation. At the same time, since the surface layer has high wear-resistance, it is not worn by friction with the warp. The surface layer also has a good anti-corrosin property and is not corroded by water from the water jet. In addition, the surface layer can be formed without degrading the material of the nozzle, and surface finishing is not required. The surface layer is firmly formed on the substrate and does not peel off from the surface of the substrate. Therefore, the sub nozzle can be used for a long period of time under optimum conditions.

Even if the present invention is applied to other machine parts such as a tension roller, a measuring roller, a yarn hook, and a needle, the surface layers formed on these machine parts are smooth and have good sliding properties. When the surface layers are brought into sliding contact with a warp or weft upon operation of these machine parts, the warp can slide easily on the surface layer and does not fray, thereby preventing quality degradation. Since the surface layer has high wear-resistance, it is not worn by sliding contact with the warp. In addition, the surface layer also has high resistance to corrosion. Even if the surface layer is brought into contact with water from the water jet system employed in the weft insering mechanism, the layer will not corrode. Furthermore, the surface layer can be formed on each of the machine parts without exposing its substrate to high temperatures, so that the substrate properties are not degraded. Upon formation of the surface layer, surface finishing need not be performed. The surface layer is firmly formed on the surface layer of the substrate and thus does not peel therefrom. Therefore, these machine parts can be used for a long period of time under optimum conditions.

The present invention can be effectively utilized for apertured parts such as a heald and a sub nozzle. According to a conventional coating method, an aperture may become clogged or the coating may peel off the surface. In particular, in machine parts such as sub nozzles with an elongated aperture having longer length than its diameter, inner coating could not be performed so far.

DETAILED DESCRIPTION OF THE PREFERRED EMBODIMENT

Figure 1:
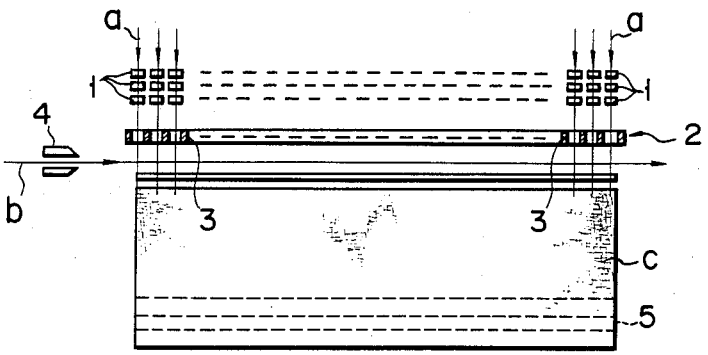
FIG. 1 is a schematic view showing an arrangement of a conventional weaving machine.

The present invention applied to various parts of weaving machines will be described in detail by way of examples.

Example 1

The present invention is applied to a heald in Example 1.

A 20% aqueous solution of $CrO_3$ was applied to the entire surface of a stainless steel plate, having a length of 302 mm, a width of 2 mm and a thickness of 0.3 mm, by dipping. The stainless steel plate with the $CrO_3$ layer was baked at a temperature of 550° C. Dipping and baking constituted one cycle, and 15 cycles were repeated to form a 3-μm thick surface layer on the surface of the plate. Healds with a surface layer were thus prepared. These healds were mounted in a frame such that heald bars passed through the mounting holes of the healds. This frame was assembled in a weaving machine, and the machine was operated.

As a comparative example, a stainless steel material was prepared, and healds without a surface treatment were obtained. These healds were assembled in a weaving machine, and the machine was operated.

When the healds of Example 1 were used, the rate of warp fraying was greatly decreased, as compared with the conventional healds. More specifically, a rate of warp fraying by the healds of Example 1 was 7%, while that by the conventional healds was 20%. Therefore, with the healds of Example 1, the quality of cloth obtained was improved, and its yield was also increased. The healds of Example 1 had high wear-resistance and maintained their initial smoothness for a long period of time. In addition, foreign material did not become attached to the healds.

The healds of Example 1 were thus smoothly operated, and the mounting holke portions through which corresponding warps passed were not damaged. Therefore, high-speed weaving could be performed, and weaving efficiency was improved.

In the healds of Example 1, a winding amount of the warp was greatly increased as compared with the conventional weaving machine. Conventional drawing-in was changed to warp connections to decrease the number of warp replacements and the load thereof.

The surface layer of each heald of Example 1 had good adhesion with the substrate and did not crack or peel from the heald upon its movement. Since this surface layer was very thin, the rigidity of the substrate was not degraded. Therefore, the quality and feeling of the finished cloth was the same as or better than that of conventional high-quality cloth.

The healds of Example 1 were not corroded by an oil attached to the warp. On the contrary, the oil improved smoothness.

When the surface layer was formed on each heald of Example 1, the substrate was not exposed to a high temperature and was not degraded.

Example 2

The present invention is applied to read wires of the reed in Example 2.

A 40% aqueous solution of $CrO_3$ was applied to the entire surface of a stainless steel (SUS430) plate having a width of 2 mm and a thickness of 0.4 mm by dipping. The stainless steel plate with the $CrO_3$ layer was baked at a temperature of 550° C. Dipping and baking constituted one cycle, and 15 cycles were repeated to form a 3-μm thick surface layer on the surface of the plate. Reed wires with a surface layer were thus prepared. These reed wires were mounted in a reed frame to constitute the reed. This reed was assembled in a weaving machine, and the weaving machine was operated.

As a comparative example, reed wires were prepared using a stainless steel (SUS430) plate without a surface treatment. A reed was prepared using these reed wires. This reed was assembled in a weaving machine, and the machine was operated for comparison.

When the reed of Example 2 was used, a rate of warp fraying by the reed was greatly decreased from 20% to 7% with respect to the comparative example. The reed wires of Example 2 had high wear-resistance and maintained initial smoothness for a long period of time. The quality of cloth was improved, and its yield was increased.

According to the reed wires of Example 2, a winding amount of the warp was greatly increased as compared with the conventional weaving machine. Conventional drawing-in was changed to warp connections to decrease the number of warp replacements and to improve the operation efficiency.

The surface layer of each reed wire of Example 2 had good adhesion with the substrate and does not interfere with flexing of the substrte. Therefore, the quality and feeling of the finished cloth was the same as or better than that of conventional high-quality cloth.

When the surface layer was formed on each reed wire of Example 2, the substrate was not exposed to a high temperature and was not degraded.

The reed wires of Example 2 were not corroded by an oil attached to the warp. On the contrary, the oil improved smoothness.

Example 3

The present invention is applied to sub nozzles in Example 3.

A 60% aqueous solution of $CrO_3$ was applied to the entire surface of a stainless steel pipe, having outer and inner diameters of 6 mm and 4 mm and a length of 50 mm, by dipping. The stainless steel pipe with the $CrO_3$ layer was baked at a temperature of 550° C. Dipping and baking constituted one cycle, and 15 cycles were repeated to form a surface layer about 4 to 5 μm thick on the surfaces of the pipe. Sub nozzles with a surface layer were thus prepared. These nozzles were assembled in a weaving machine, and the weaving machine was operated.

As a comparative example, sub nozzles were prepared using a stainless steel pipe without a surface treatment. These sub nozzles were assembled in a weaving machine, and the machine was operated for comparison.

When the nozzles of Example 3 were used, a rate of warp fraying by the sub nozzles was greatly decreased from 19% to 8% with respect to the comparative example. The sub nozzles of Example 3 had high wear-resistance and maintained initial smoothness for a long period of time.

The surface layer of each sub nozzle of Example 3 had good adhesion with the substrate and did not crack or peel from the sub nozzle upon its movement.

The substrate of each sub nozzle was not exposed to a high temperature during formation of the surface layer thereon. Therefore, the substrate was not degraded.

Examples 4 and 5

A reed wire (sample No. 1) without a surface layer, reed wires (sample Nos. 2 and 3) each with a surface layer according to the present invention, and reed wires (sample Nos. 4 to 6) respectively having surface layers according to conventional methods were prepared. Samples 2 and 3 were prepared following the procedures of Example 2.

TABLE 1

| Sample No. | Surface Layer Forming Method | Surface Layer Material | Surface Layer Thickness | Surface Layer Hardness (HV) | Substrate Material |
|---|---|---|---|---|---|
| 1 | No surface layer | — | — | 280 (Substrate) | SUS 430 |
| 2 | Present invention | $Cr_2O_3$ | 4–5μ | 550 | SUS 304 |
| 3 | Present invention | $Cr_2O_3$ | 4–5μ | 550 | SUS 430 |
| 4 | PVD | TIC | 2μ | 2000 | SUS 430 |
| 5 | CVD | TIN | 6–7μ | 3000 | SUS 420J2 |
| 6 | Plating | Nickel-Plated | 5μ | 550 | SUS 420J2 |

The reeds of the resultant reed wires were respectively assembled in weaving machines. The weaving machines were operated under the following conditions. A drive rotational speed was about 800 rpm, a drive time ws 24 hours, a raw yarn used was Teijin ES150 d/f, a take-up rate of the yarn, with a tension force of 65 to 85 g, was about 0.3 m/minute. The state of damage on the yarn surface upon sliding contact between each reed wire and the yarn was examined.

The state of damage on the surface of each sample was evaluated by observation (e.g., fraying, end breakage, and feeling) and by touch. The evaluation results were classified into five ranks from W0 (no damage) to W5 (worst damage). The evaluation results for the reed wires are shown in Table 2 below:

TABLE 2

| Sample No. | 1 | 2 | 3 | 4 | 5 | 6 |
|---|---|---|---|---|---|---|
| Damage Rank | W5 | W0.5 | W1 | W4 | W3 | W5 |

According to the evaluation results, the wires in sample Nos. 2 and 3 were less damaged than those with the conventional surface layers.

The degrees of damage of the yarns by the reed wires of sample Nos. 2 and 3 were less than those by the conventional reed wires. More specifically, when the reed wire of sample No. 2 or 3 was used, little damage to the yarn occurred, and the yarn was kept soft. However, with the conventinal reed wires, the yarns were considerably damaged to result in fraying and end breakage and the test could not be continued for 24 hours.

Example 6

Figure 2:
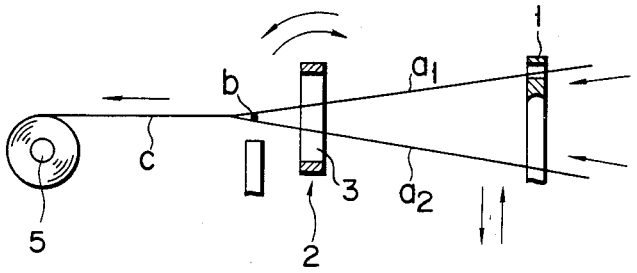
FIG. 2 is a side view of the machine of FIG. 1.
Figure 3:
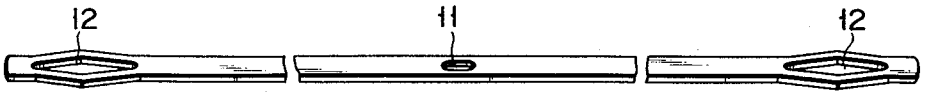
FIG. 3 is a perspective view of a heald.
Figure 5:
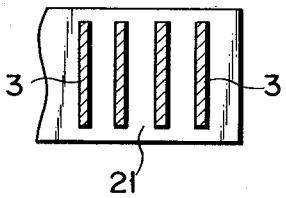
FIG. 5 is a sectional view of the reed of FIG. 4 taken along the line A—A thereof.
Figure 4:
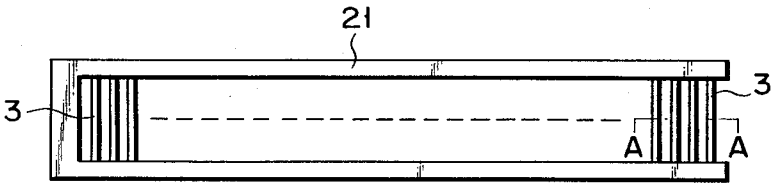
FIG. 4 is a schematic view of a reed.
Figure 6:
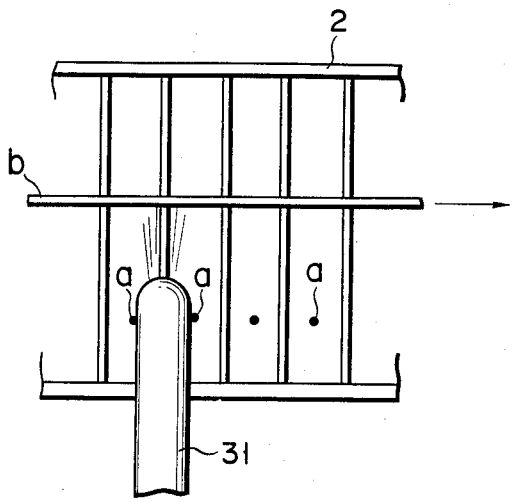
FIG. 6 is a schematic view of a sub nozzle of a water jet loom.
Figure 7:
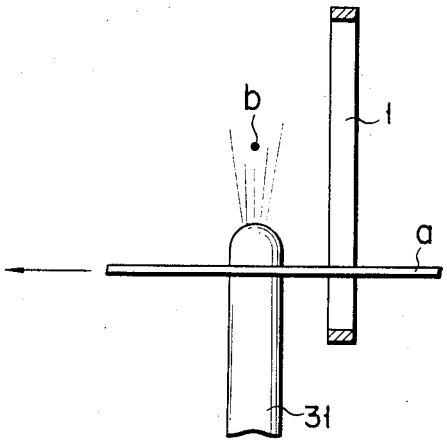
FIG. 7 is a side view of the sub nozzle of FIG. 6.

In the weaving machine shown in FIGS. 1 and 2, warps a are displaced in a direction perpendicular to the running direction due to vertical movement of healds 1 and swinging of reed 2, thus causing lateral vibrations. A distance between warps a is thus changed, and warps a run while they are not parallel to each other. In this state, warps a are woven with weft b, and resultant woven fabric c has an uneven texture, in which the distance between warps a is partially increased or decreased.

Figure 8:
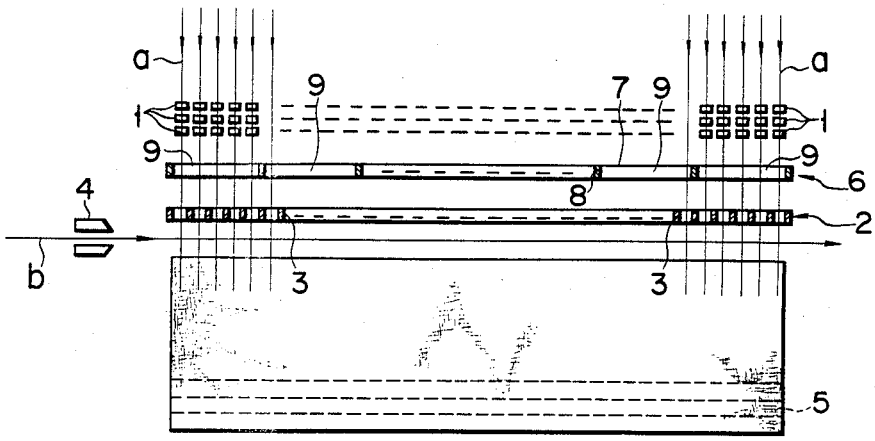
FIG. 8 is a schematic view showing an arrangement of a weaving machine with a fixed lead guide.
Figure 9:
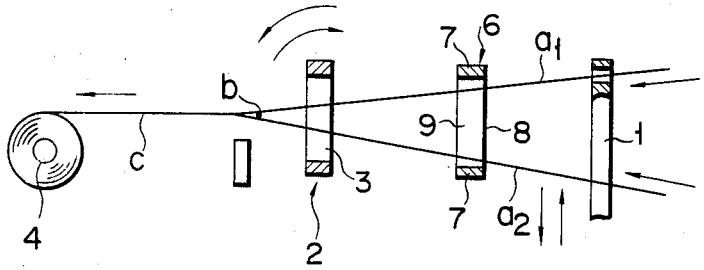
FIG. 9 is a side view of the machine of FIG. 8.
Figure 10:
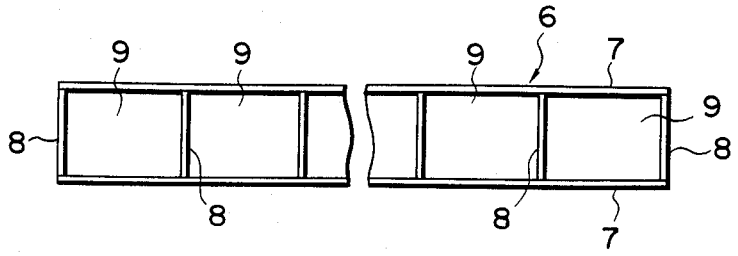
FIG. 10 is a schematic view showing an arrangement of the fixed lead guide.

This problem can be solved by arranging fixed lead guide 6 between healds 1 and reed 2, as shown in FIGS. 8 and 9. Guide 6 has a length corresponding to the overall length of the array of warps a. Guide 6 is located on the downstream side of warps a with respect to healds 1, i.e., between reed 2 and healds 1. Guide 6 is fixed in position by a member (not shown). As shown in FIG. 10, guide 6 has lateral bases 7 and a plurality of partition members 8 fixed thereto, at equal intervals, along the aligning direction of warps a. A plurality of guide portions 9 are defined by adjacent partition members 8 to pass warps a therethrough. Bases 7 and members 8 of guide 6 comprises substrates of a material containing iron such as stainless steel or high-speed steel.

The operation of the weaving machine with guide 6 will now be described. A plurality of warps a fed from a let-off mechanism are run in the direction indicated by arrows in FIG. 8 while they are taken up by take-up mechanism 5. Warps a are separated while running and pass through 11 mails of healds 1. Upon vertical movement of healds 1, warps a are moved up and down. Warps a then pass through portions 9 of guide 6 arranged between healds 1 and reed 2. In this case, warps a are divided into groups, each consisting of a plurality of warps a, and the groups respectively pass through portions 9. Warps a pass through gaps between adjacent reed wires 3 of reed 2. Weft b is moved along the aligning direction of warps a and passes between upper warps a1 and lower warps a2, which have passed through the gaps between reed wires 3 of reed 2. Thereafter, reed 2 pivots to beat up weft b passing between the upper warps a1 and lower warps a2. This operation is repeated to wave fabric c. The resultant fabric c is taken up by mechanism 5.

In this weaving machine, since warps a pass through portions 9 of guide 6 between healds 1 and reed 2, lateral movement (i.e., the warp aligning direction) of warps a is prevented by portions 9 of guide 6, so that warps a are linearly guided along the running direction. Portions 9 prevent lateral vibration of warps a and guide warps a linearly. Thus, even healds 1 are vertrically moved and reed 2 swings, lateral vibrations of warps a are prevented by guide 6. Therefore, since warps a are woven with weft b while they are running parallel to each other, high-quality fabric c with uniform texture can be obtained.

In the water jet loom, water droplets from the water jet of main nozzle or weft inserting mechanism 4 are blocked by guide 6. Therefore, the water droplets do not reach healds 1, and healds 1 will not be corroded.

Figure 11:
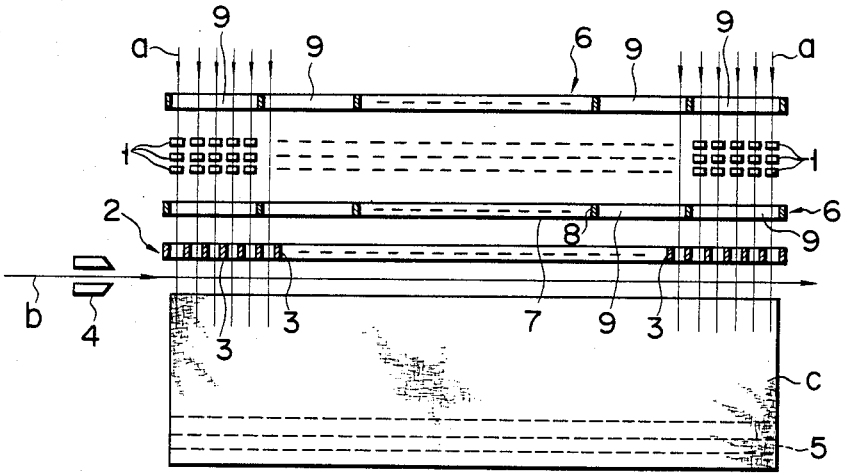
FIG. 11 is a schematic view showing an arrangement of a weaving machine with two fixed lead guides.
Figure 12:
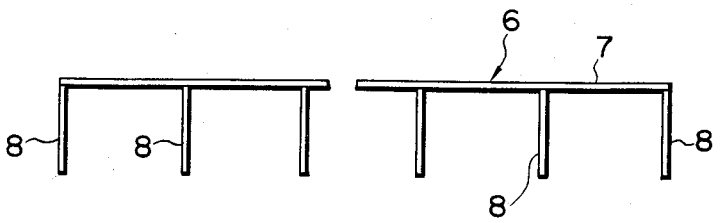
FIG. 12 is a schematic view showing another arrangemetn of the fixed lead guide.

In Example 6, guide 6 is arranged on the downstream side of healds 1. However, as shown in FIG. 11, another fixed reed guide 6 can also be arranged on the upstream side of healds 1, and lateral vibrations of warps a can be further prevented by guides 6. Alternatively, even if guide 6 is arranged only on the upstream side of healds 1, lateral vibrations of the warps a can be prevented. Guide 6 may also be arranged in another position, and may have the shape shown in FIG. 12.

When warps a pass through guide 6 and are brought into sliding contact with parts thereof, warps a fray to degrade the quality of cloth. In order to prevent this, guide 6 comprises a substrate of a material containing iron as a major constituent, and a surface layer is formed on the surface of the substrate to prevent fraying. In this case, the surface layer contains chromium oxide ($Cr_2O_3$) converted from a chromium compound upon its heating and has an intermediate layer containing a reaction product between the substrate and chromium oxide ($Cr_2O_3$) is formed at the interface between the substrate and the surface layer. This surface layer can be formed by the same process shown in Examples 1 to 3.

The surface layer formed on guide 6 is smooth or has a good sliding property. When warps a are brought into sliding contact with the surface layer, warps a smoothly slide along the surface of the layer to prevent fraying and to prevent degradation of the cloth feeling. The surface layer has high wear-resistance and is not worn upon sliding contact with warp a. The surface layer also has high resistance to corrosion. Therefore, even if the surface layer is brought into contact with water in the water jet system, the layer is not corroded and hence the substrate is not degraded. In addition, surface finishing is not required after formation of the surface layer. The surface layer is firmly formed on the surface of the substrate, and does not peel therefrom. Therefore, guide 6 can be used for a long period of time under optimum conditions.

What is claimed is:

1. Machine parts which are in contact with an elongated fibrous member, each part comprising a substrate of an iron series metal and a smooth, wear-resistant surface layer formed on a surface of said substrate, which substantially contains chromium oxide ($Cr_2O_3$) as a constituent, the chromium oxide being converted from a chromium compound upon heating thereof, and an intermediate layer including a reaction product between the chromium oxide in said surface layer and said substrate being formed at an interface between said surface layer and said substrate.

2. Machine parts according to claim 1, wherein said machine parts have an aperture.

3. Machine parts according to claim 2, wherein said machine parts are a heald of a weaving machine or a sub nozzle of a fluid jet type weaving machine.

4. Machine parts according to claim 1, wherein said surface layer has a thickness of 1 to 50 μm.

5. Machine parts according to claim 1, wherein said surface layer has a thickness of 1 to 10 μm.

6. Machine parts according to claim 1, wherein said surface layer has a thickness of 2 to 6 μm.

7. Machine parts according to claim 1, wherein the chromium compound is $CrO_3$.

8. Machine parts according to claim 1, wherein said machine parts are a reed wire of a weaving machine.

9. Machine parts according to claim 1, wherein said machine parts are a tension roller, a measuring roller, a yarn hook, or a needle of a weaving machine.

10. Machine parts according to claim 1, wherein said intermediate layer has a thickness of 0.5 to 3.0 μm.

11. Machine parts according to claim 1, wherein said intermediate layer comprises $FeO.Cr_2O_3$ and $Cr_2O_3$.

* * * * *